United States Patent [19]

Shoemaker

[11] Patent Number: 4,721,238

[45] Date of Patent: Jan. 26, 1988

[54] SPRING RETAINER SHOULDER HOLSTER

[75] Inventor: Randy R. Shoemaker, LaVerne, Calif.

[73] Assignee: Tex Shoemaker & Sons, Inc., San Dimas, Calif.

[21] Appl. No.: 801,203

[22] Filed: Nov. 25, 1985

[51] Int. Cl.[4] ..... F41C 33/02

[52] U.S. Cl. ..... 224/243; 224/206; 224/911

[58] Field of Search ..... 224/192, 193, 196, 198, 224/206, 243, 911, 912, 197

[56] References Cited

U.S. PATENT DOCUMENTS

| | | | |
|---|---|---|---|
| 1,148,935 | 8/1915 | Snavely | 224/243 |
| 2,213,472 | 9/1940 | Myres | 224/243 |
| 3,904,091 | 9/1975 | Jones | 224/911 X |
| 4,258,871 | 3/1981 | McMahon | 224/192 |

*Primary Examiner*—Henry J. Recla
*Assistant Examiner*—David Voorhees
*Attorney, Agent, or Firm*—Boniard I. Brown

[57] ABSTRACT

An easily drawn shoulder holster primarily intended to retain automatic handguns having upward, rearwardly extending hammer cover assemblies. The holster includes a folded, multilayer sheath with an inner layer of leather, an outer layer of leather and a central stiffening layer, preferably of metal. The sheath covers the body of the handgun including its hammer cover while allowing the butt pointed to the front, and the barrel pointed downwardly, to extend therefrom. A redundant spring extends across the front of the trigger guard of the handgun to urge the hammer cover assembly up into a downwardly facing, upper pocket in the sheath for retention of the handgun.

14 Claims, 6 Drawing Figures

SPRING RETAINER SHOULDER HOLSTER

BACKGROUND OF THE INVENTION

A law enforcement officer, body guard, or the like must be able to draw his handgun easily and quickly. When in plain clothes, it is also important that the handgun be concealed by being carried in an unobtrusive spot. For that reason, shoulder holsters are popular which fit underneath a coat generally in an area of the arm pit where their bulk is not easily recognized. The shoulder holster must allow quick and easy handgun draw, yet the holster must secure the handgun during strenuous activity. The holster also must assure that the strenuous activity does not tend to cock the weapon for accidental discharge should the safety be left off at times when immediate use is contemplated.

A typical shoulder holster is shown by BOOTH in U.S. Pat. No. 2,579,782. In a BOOTH holster, the weapon is carried in the conventional barrel-down location. To remove the handgun from the Booth holster requires lifting the handgun from the holster. This lifting is awkward, especially when a tight-fitting jacket is being worn. To overcome this awkwardness, some shoulder holsters release the handgun to the front or rear. A front opening shoulder holster is shown in BIANCHI, et al, U.S. Pat. No. 4,084,734 where an internal spring within the sheath provides squeezing side force to retain the weapon in the holster by means of friction. The amount of weapon retaining side force depends in large measure upon the design of the weapon and therefore a single holster design is rarely suitable for handguns of different styles. Also, a relatively heavy spring is required to generate sufficient friction and the holster must extend over the entire length of the weapon to apply the friction. This makes such holsters relatively heavy and bulky. Therefore, there has been a need to provide a lightweight shoulder holster which can retain an automatic handgun which has a retaining system that allows easy and quick access to the handgun in proper orientation for its use.

SUMMARY OF THE INVENTION

The present invention provides a lightweight shoulder holster for automatic handguns. The holster includes a gun retaining sheath which extends over the rearwardly extending hammer assembly of an automatic handgun and forward over a portion of its body allowing the handgun's barrel, trigger guard, trigger, and butt to remain exposed. The sheath is connected to a ring-shaped shoulder strap assembly in an orientation which points the barrel downwardly and the butt forwardly so that the handgun can be drawn by an arm motion across the wearer's body. The handgun is retained in the sheath by a spring loop which extends from either side of the sheath to engage around the handgun at a notch present between the barrel and the trigger guard. The loop includes redundant, parallel springs for safety. The springs are covered by suitable cushioning material to prevent wear of the handgun or the users clothing.

It is therefore an object of the present invention to provide a shoulder holster which can retain automatic handguns in suitable locations for concealment and quick usage.

Another object is to provide a lightweight shoulder holster which can retain an automatic handgun securely even during strenuous actively.

Another object is to provide a shoulder holster which is relatively economical to construct yet has desirable security features and will retain a broad range of automatic handguns.

These and other objects and advantages of the present invention will be come apparent to those skilled in the art after considering the following detailed Specification together with the accompanying drawing wherein:

DETAILED DESCRIPTION OF THE SHOWN EMBODIMENT

Figure 1:
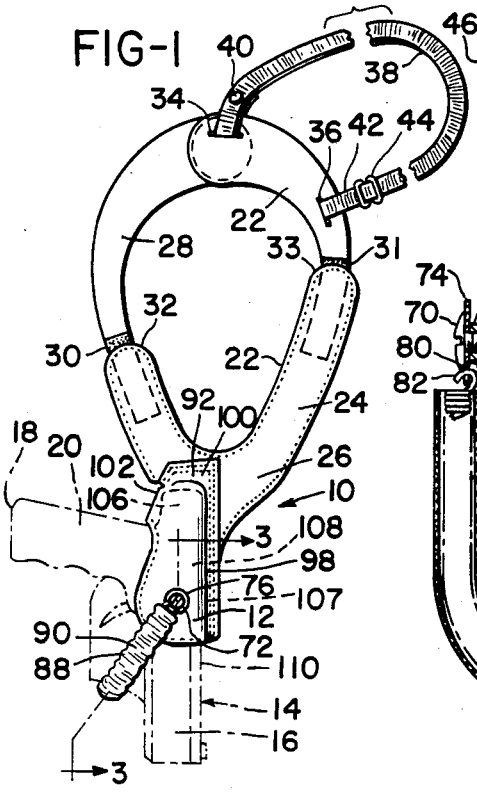
FIG. 1 is a side, elevational view of a shoulder holster constructed according to the present invention.

Referring to the drawing more particularly by reference numbers, number 10 in FIG. 1 refers to a shoulder holster constructed according to the present invention. The holster 10 includes a sheath 12 which retains an automatic pistol 14 inserted therein with its muzzle 16 pointed downwardly and the butt 18 of its grip 20 pointed in the direction that the user normally is facing. The holster 10 is connected to the user by means of a loop-shaped shoulder strap 22 which fits about a user's shoulder nestling the sheath 12 and pistol 14 in the general location of the user's armpit. When configured, as shown in FIG. 1, the holster 10 would be located near the user's left armpit, as is typical for a right handed user. The holster 10 is bilaterally symmetric so it can be worn on the right shoulder by flipping the strap 22 over at which time its usual outer surface 24 becomes its inner surface.

As shown, the strap 22 includes a lower U-shaped portion 26 fixedly connected to the sheath 12 and an upper inverted U-shaped portion 28 adjustably connected to the lower portion 26 by Velcro tabs 30 and 31 which are adjustably inserted inside velcro lined sheaths 32 and 33. Slots 34 and 36 are provided in the upper portion 28 of the strap 22. An elastic band 38 attaches through the slot 34 by means of a snap 40 and through the slot 36 by means of an adjustment loop 42 and buckle 44. The elastic band 38 assures that the shoulder strap 22 does not ride out and off the user's shoulder during strenuous activity.

Figure 2:
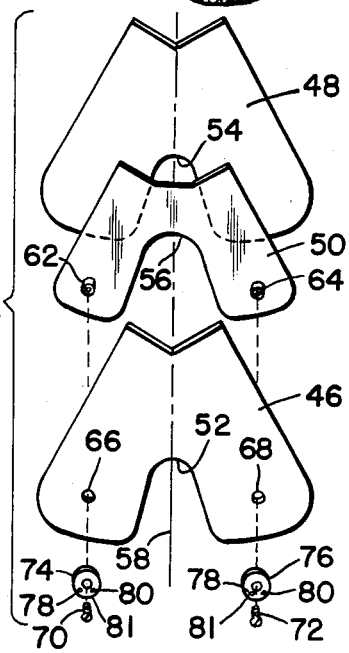
FIG. 2 is an exploded view of the construction details of the sheath of the holster of FIG. 1.

As shown in FIG. 2, the sheath 12 is constructed from three main parts, an outer leather piece 46, an inner leather piece 48 and a sheet metal insert 50 positioned therebetween. The leather pieces 46 and 48 and the insert 50 each include a notch 52, 54 and 56 respectively. The pieces 46 and 48 and the insert 50 are bent about a fold line 58, aligned with the notches 52, 54, and 56, to form the sheath 12.

Figure 3:
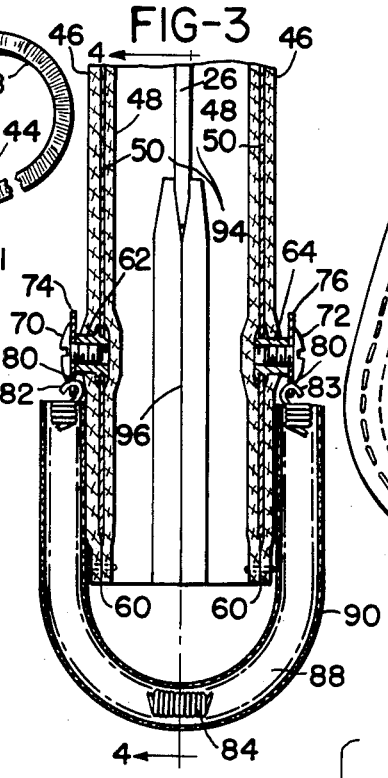
FIG. 3 is an enlarged, cross-section view taken on line 3—3 of FIG. 1.
Figure 4:
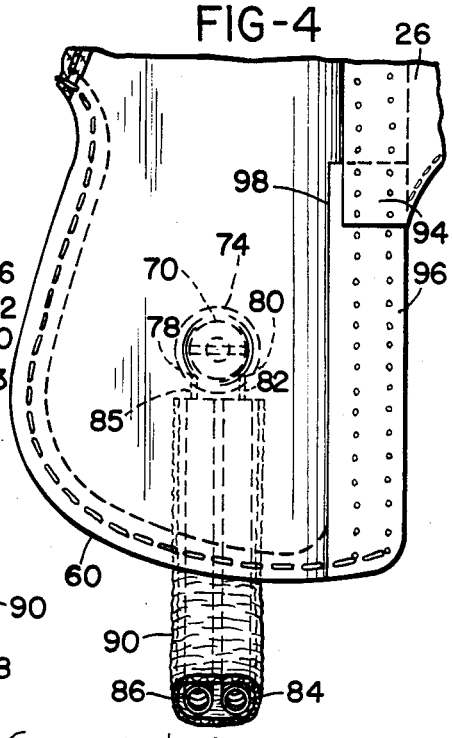
FIG. 4 is a cross-sectional side view taken at line 4—4 of FIG. 3.

As shown in FIGS. 3 and 4, the pieces 46 and 48 are sewn together about their periphery 60 entrapping the insert 50 therebetween. The inner leather piece 48 provides a smooth, nonabrasive contact surface for the pistol 14, whereas the outer leather piece 46 provides smooth contact with the user and his clothes. The sheet metal insert 50 includes blind nuts 62 and 64 fixedly connected thereto which extend through holes 66 and 68 in the outer leather piece 48 positioned in alignment therewith. Screws 70 and 72 connect washers 74 and 76 to the sheath 12 by being inserted within the blind nuts 62 and 64 respectively. Each washer 74 and 76 includes a pair of holes 78 and 80 adjacent the periphery 81 thereof. The holes 80 retain the opposite ends 82 and 83 of a coil spring 84 and the holes 78 are connected to the opposite ends 85 of a similar coil spring 86 so that both springs 84 and 86 are formed in a loop 88 inside a cushion cover 90, which usually is constructed from nylon.

When folded, the upper portions 92 of the leather pieces 46 and 48 respectively, are stitched to the lower portion 26 of the strap 22 as are the upper rearward peripheral portions 94 of the pieces 46 and 48. The remainder 96 of the rear peripheral portions of the pieces 46 and 48 are stitched together. Therefore, the sheath 12 is closed along its back peripheral edge 98, its upper peripheral edge 100 and its front 102 above the notch 52. This provides a downwardly facing pocket 104 which retains the hammer assembly 106 of the pistol 14 inserted therein while the upper edge 107 of its body 108 and barrel 110 fit securely against the back peripheral edge 98.

Figure 5:
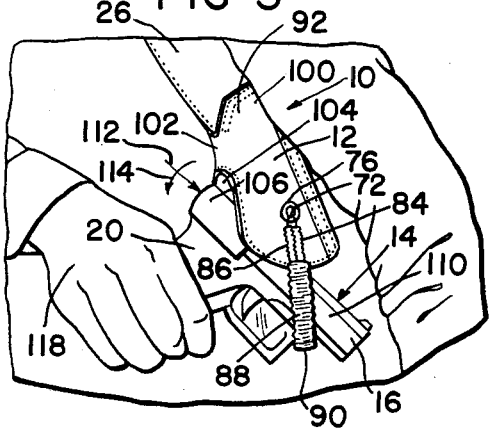
FIG. 5 is a perspective view showing a handgun being withdrawn from the position shown in FIG. 1 in the initial stages of the draw.
Figure 6:
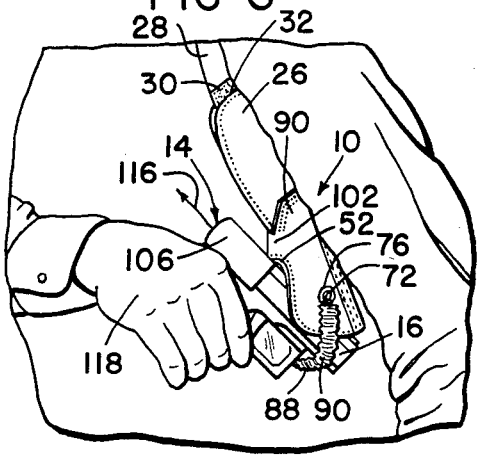
FIG. 6 is a perspective view similar to FIG. 5 showing the later stages of the same draw.

When the pistol 14 is positioned, as shown in FIG. 1, the spring loop 88 retains the pistol 14 in the position shown. When it is desired to withdraw the pistol 14 from the holster 10, downward motion in the direction of arrow 112 in FIG. 5 and a slight rotational movement in the direction of the arrow 114 free the pistol 14 from the pocket 104. Thereafter, the springs, 84 and 86 assist in forcing the pistol 14 in the direction of arrow 116 (FIG. 6) into the hand 118 of the user who continues to withdraw the pistol 14 until it is clear of the loop 88 and is ready for use. To place the pistol 14 back within the holster 10, the barrel 110 is inserted within the loop 88, as shown in FIG. 6, and then force is applied opposite to the arrow of 116 to stretch the loop 88, as shown in FIG. 5, until the hammer assembly 106 of the pistol 14 clears the front 102 by passing through the notch 52. The pistol 14 thereafter is reseated in the pocket 104, as shown in FIG. 1.

Thus there has been shown and described a novel spring retainer shoulder holster which fulfills all of the objects and advantages sought therefor. Many changes, modifications, variations and other uses and applications of the subject invention will, however, become apparent to those skilled in the art after considering this Specification together with the accompanying drawing. All such changes, modifications, variations and other uses and applications which do not depart from the spirit and scope of the invention are deemed to be covered by the invention which is limited only by the claims which follow.

What is claimed is:

1. A holster for releasably retaining a handgun, said holster including:

a sheath having:

first and second sides;

a closed back;

an open front;

a closed top positioned between said closed back and said open front; and a downwardly facing pocket extending beneath said closed top;

a resilient loop extending between said first and second sides across said open front, said resilient loop being adapted to engage a handgun to bias it up into said pocket, said resilient loop including:

a pair of parallel coil springs which extend along said resilient loop; and a flexible cover positioned along said parallel coil springs;

a U-shaped strap having:

a first end with attachment means thereon;

a second bifurcated end with attachment means thereon; and a center portion therebetween, said center portion being connected to said sheath; and an inverted U-shaped strap having:

a first end adapted to adjustably engage said attachment means of said first end; and a second end adapted to adjustably engage said attachment means of said second end, said U-shaped and inverted U-shaped straps forming a shoulder loop for attachment of said holster to the user.

2. A holster for releasably retaining a handgun having a body, a handle, and a barrel, in a predetermined position on a user's body, said holster including:

means for attachment to a user's body a sheath formed to cover at least a portion of the body of the handgun with the handle and barrel extending therefrom, said sheath having:

first and second sides;

a closed back;

an open front;

a pocket between said closed back and open front;

an outer flexible layer;

an inner flexible layer; and a stiffener layer sandwiched between said inner and outer layers, said layers each having:

a notch; and opposite side edges, said opposite side edges being folded toward each other about said notch and connected to form said sheath; and a resilient loop extending between said first and second sides across said open front, said resilient loop being adapted to bias the handgun up into said pocket and including:

first and second ends, said stiffener layer including:

blind attachment means for connecting said first and second ends of said resilient loop to said sheath, said outer flexible layer defining:

first and second holes in alignment with said blind attachment means, and said holster further including:

first and second connection members adapted to connect with said first and second ends of said resilient loop; and first and second fasteners extending through said first and second holes respectively to connect said first and second connection members to said sheath.

3. The holster defined in claim 2 wherein said resilient loop includes:

a pair of parallel coil springs; and a flexible cover positioned over said parallel coil springs with said first and second ends extending therefrom.

4. The holster defined in claim 3 wherein said sheath is bilaterally symmetric about said notch.

5. The holster defined in claim 4 wherein said means for attachment to a users body include:

a U-shaped strap having:
a first bifurcated end;
a second bifurcated end; and
a center portion therebetween, said center portion being positioned between said opposite side edges of said inner flexible layer; and
an inverted U-shaped strap having:
a first end adapted to adjustably engage said first bifurcated end;
a second end adapted to adjustably engage said second bifurcated end.

6. A shoulder holster for releasably retaining an automatic handgun which has a body with a hammer cover, a handle with a butt, a barrel with a muzzle, and a trigger guard, in a predetermined position on a users body, said holster including:
a sheath formed to cover at least a portion of the body of the automatic handgun with the butt of the handle and the trigger guard extending therefrom forwardly and the barrel extending therefrom downwardly, said sheath having:
first and second sides;
a closed back;
an open front;
a closed top positioned between said closed back and open front; and
a downwardly facing pocket extending beneath said closed top adapted for engagement with the hammer cover; and
a resilient loop extending between said first and second sides across said open front, said resilient loop being adapted to engage the automatic handgun between its trigger guard and barrel and to bias its hammer cover up into said pocket.

7. The holster defined in claim 6 wherein said sheath includes:
an outer flexible layer;
an inner flexible layer; and
a stiffener layer sandwiched between said inner and outer layers, said layers each having:
a notch; and
opposite side edges, said opposite side edges being folded toward each other about said notch and connected to form said sheath, said notch being adapted to engage the automatic handgun between its handle and its hammer cover.

8. The holster defined in claim 7 wherein said resilient loop inlcudes:
first and second ends, and wherein said stiffener layer includes:
blind nut means for connecting said first and second ends of said resilient loop to said sheath.

9. The holster defined in claim 8 wherein said outer flexible layer defines:
first and second holes in alignment with said blind nut means, and said holster further includes:
first and second connection members adapted to connect with said first and second ends of said resilient loop;
first and second fasteners extending through said first and second holes respectively to connect said first and second connection members to said sheath.

10. The holster defined in claim 9 wherein said resilient loop includes:
a pair of parallel coil springs; and
a flexible cover positioned over said parallel coil springs with said first and second ends extending therefrom.

11. The holster defined in claim 6 wherein said resilient loop includes:
a pair of parallel coil springs; and
a flexible cover positioned along said parallel coil springs.

12. The holster defined in claim 7 wherein said sheath is bilaterally symmetric about said notch.

13. The holster defined in claim 12 wherein said sheath includes:
an outer flexible layer;
an inner flexible layer; and
a stiffener layer sandwiched between said inner and outer layers, said layers each having:
a notch; and
opposite side edges, said opposite side edges being folded toward each other about said notch and connected to form said sheath, said notch being adapted to engage the automatic handgun between its handle and its hammer cover.

14. The holster defined in claim 13 wherein said holster includes:
a U-shaped strap having:
a first bifurcated end;
a second bifurcated end; and
a center portion therebetween, said center portion being positioned between said opposite side edges of said inner flexible layer; and
an inverted U-shaped strap having:
a first end adapted to adjustably engage said first bifurcated end;
a second end adapted to adjustably engage said second bifurcated end, said U-shaped and inverted U-shaped straps forming a shoulder loop for attachment of said holster to the user.

* * * * *